United States Patent [19]

Moll et al.

[11] 4,031,361

[45] June 21, 1977

[54] ELECTROMECHANICAL COUNTER

[75] Inventors: Eberhard Moll, Magstadt, Germany; Leo M. Walch, Jr., Pittsburgh, Pa.

[73] Assignee: Rockwell International Corporation, Pittsburgh, Pa.

[22] Filed: Jan. 14, 1976

[21] Appl. No.: 648,855

[52] U.S. Cl. ..... 235/92 C; 235/92 R; 235/92 FP

[51] Int. Cl.[2] ..... G06M 1/06; G06M 3/12

[58] Field of Search ..... 235/92 C, 92 FP, 91 M

[56] References Cited

UNITED STATES PATENTS

| | | | |
|---|---|---|---|
| 3,551,648 | 12/1970 | Zimmerman et al. | 235/92 C |
| 3,619,577 | 11/1971 | Hoffman | 235/92 C |
| 3,761,015 | 9/1973 | Cook | 235/92 C |

*Primary Examiner*—Joseph M. Thesz

[57] ABSTRACT

A clapper which is movable in response to an electric signal is mounted for pivotal movement about a first axis. A verge is mounted for pivotal movement about a second axis parallel to and spaced from the first and is drive connected to a counter. The clapper and verge are interconnected at a point intermediate the first and second axis and pivotal movement of the clapper in one direction will cause pivotal movement of the verge in the opposite direction. The centers of gravity of the clapper and the verge are respectively coincident with the first and second axes.

5 Claims, 2 Drawing Figures

ELECTROMECHANICAL COUNTER

BACKGROUND OF THE INVENTION

The present invention relates to electromechanical counters adapted to be operated by discrete pulses of electric power originating from a source remote from the counter location. An example of such a counter is the one disclosed in U.S. Pat. No. 3,700,163 dated Oct. 24, 1972. In the metering of utilities supplied to private residences such as electricity, gas and water it is sometimes desirable, particularly in the northern latitudes to prevent meter freeze-up in the case of water, to locate the meters within the house. When this is done, however, with conventional meters which have the counter associated with the meter itself, it is necessary for the meter reader to gain access to the house in order to take periodic readings. Such access is not always readily available to the meter reader; however, because of a number of reasons such as absence of the owner or, in some cases, reluctance of the owner to willingly give such access. Therefore, it is desirable to provide a counter which can be mounted outside of the residence structure and which is electrically connected to a pulse producing means included as part of the metering mechanism within the residence. For a variety of reasons it is desirable that such pulse producing means be of self-generating type, that is, not dependent on house power to produce the pulse which is to be transmitted to the remote counter. An example of a meter provided with such a pulse producing means of the self-generating type is disclosed in U.S. Pat. No. 3,685,353 dated Aug. 22, 1972.

While pulse generators of the type therein disclosed have the advantage of being self-contained, compact and not dependent on the house power, the magnitude of the power pulses which they are capable of producing is limited by the load which may be imposed on the meter to drive the generator. If the generator were to impose too high a load on the meter, its accuracy would be adversely affected and performance would not conform to industry standards. Therefore, since the magnitude of the power of the pulse must be held to a minimum, the remote counter must be capable of reliable operation in response to pulses of a relatively low power level. Typical of the prior art counters is the one shown in U.S. Pat. No. 3,725,648 dated Apr. 3, 1973. As there shown, an electric coil is energized to induce pivotal motion of a pole plate 40 (clapper) which in turn causes pivotal motion of a ratchet arm 36 Z(verge) which is drive connected to a series of counter wheels. The verge is biased to its initial position by means of a spring 38. When a pulse is received in the coil it is energized and the clapper pivots to cause pivotal motion of the verge against the bias of spring 38 to drive the counter. When the coil is de-energized the spring returns the verge and clapper to their initial positions. Because of the lower power levels at which such counters must operate when energized from remote self-generating devices, the movable parts must be as light in weight as possible and the bias of the spring which must be overcome should be as small as possible.

Another requirement of such counters is that they be relatively immune from the effects of shocks; that is, that they should not operate to advance the counter wheels when shocks or blows are imposed on the counter or its housing. Counters of the type shown for example in Pat. No. 3,700,163 are usually adapted to operate in connection with pulse generating means which produce pulses having a power level of relatively large magnitude. When this is the case, relative immunity from shock can be achieved by simply providing a biasing spring which imposes a bias of succicient force to prevent operation when shocks are imposed on the counting mechanism. However, when a counter must operate in response to a pulse having a relatively low power level, such high biasing forces cannot be accepted simply because the power to operate the counter against such high biasing forces is not available. A proposed solution to the problem hereinabove defined is described in U.S. Pat. No. 3,619,577 dated Nov. 9, 1971. However, the counter disclosed has certain advantages in that it does not provide insensitivity to all types of shocks which such counters may be subjected to.

SUMMARY OF THE INVENTION

It is therefore an object to the present invention to provide a remotely located electromagnetic counter which will operate in response to electrical pulses of a relatively low power level and yet be immune from the effect of the transient shocks.

It is a further object of the present invention to provide an electromagnetic counting mechanism which is insensitive to a shock imposed from any direction.

It is an additional object of the present invention to provide an electromagnetic counter which is insensitive to linearly imposed shocks as well as rotary shocks.

It is another object of the present invention to provide a counter in accordance with the foregoing objects and which is operable in response to pulses of a relatively lower power level.

The aforementioned objectives can be achieved by providing a counter having a separate clapper and verge each of which is pivotally mounted and interconnected with each other for concomitant movement at a point between their respective axes of rotation with the centers of gravity of each being located coincident with their respective axes of rotation. The distance between the axis of rotation of the clapper and the point of interconnection between the clapper and verge and the distance between the axis of rotation of the verge and said point of interconnection is selected so that the ratio of these distances is equal to the ratio of the moment of inertia of the clapper about its center of gravity and the moment of inertia of the verge about its center of gravity. This relationship may be exposed as follows:

$$I_v/I_c = a/b$$

where $I_v$ = The moment of inertia of the verge about its center of gravity.

$I_c$ = The moment of inertia of the clapper about its center of gravity.

a = The distance between the axis of rotation of the verge and point of interconnection between the verge and clapper.

b = The distance between the axis of rotation of the clapper and the point of interconnection between the clapper and verge.

DESCRIPTION OF THE PREFERRED EMBODIMENT

Figure 1:
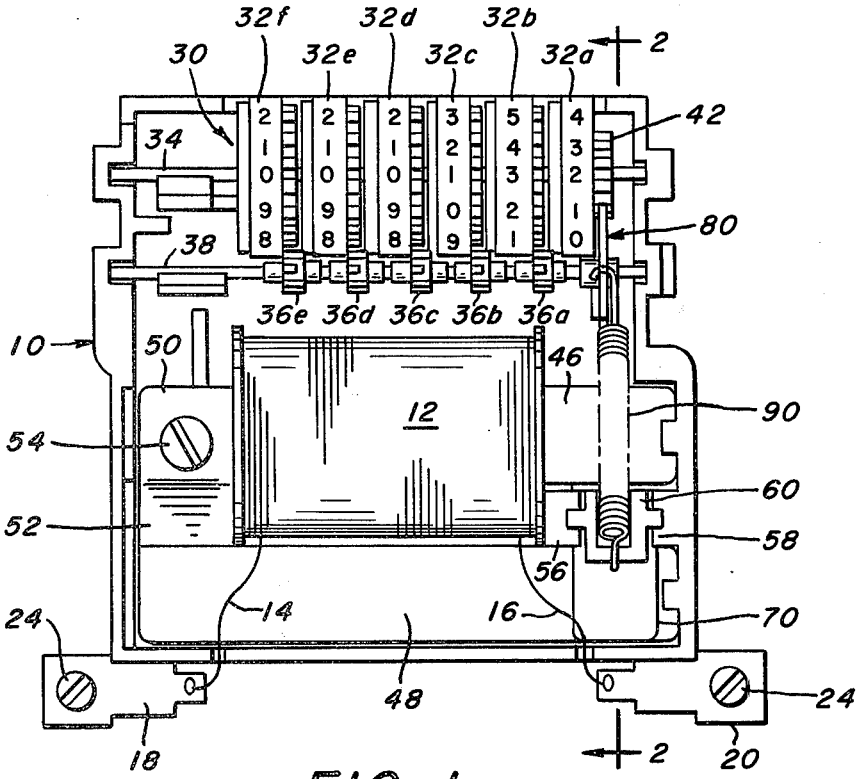
FIG. 1 is a side view of a counter employing the invention hereof showing the relationship between the clapper, verge and the counter.

As shown in the drawings, in the components of the counting mechanism are mounted on a support structure indicated generally by the numeral 10. A coil 12 has leads 14 and 16 connected respectively to terminals 18 and 20 which in turn are adapted to be connected by means of screws 22 and 24 to transmission lines not shown, which in turn are connected to the output terminals of a generating device such as that disclosed in U.S. Pat. No. 3,685,353. A digital counting mechanism indicated generally by the numeral 30 is comprised of six digit wheels 32*a*-32*f* respectively all rotatably mounted on a shaft 34 supported in support structure 10. Transfer pinions 36*a*-36*e* are rotatably mounted on a shaft 38 also supported in structure 10. The transfer pinions 36*a*-36*e* interconnect the digit wheels 32*a*-32*f* whereby each digit wheel will be rotated an angular distance corresponding to one digit upon one complete revolution of the next lower order digit wheel, all in the manner well known in the art. A star wheel 42 having equally spaced teeth 44 is formed integrally with units digit wheel 32*a*.

Figure 2:
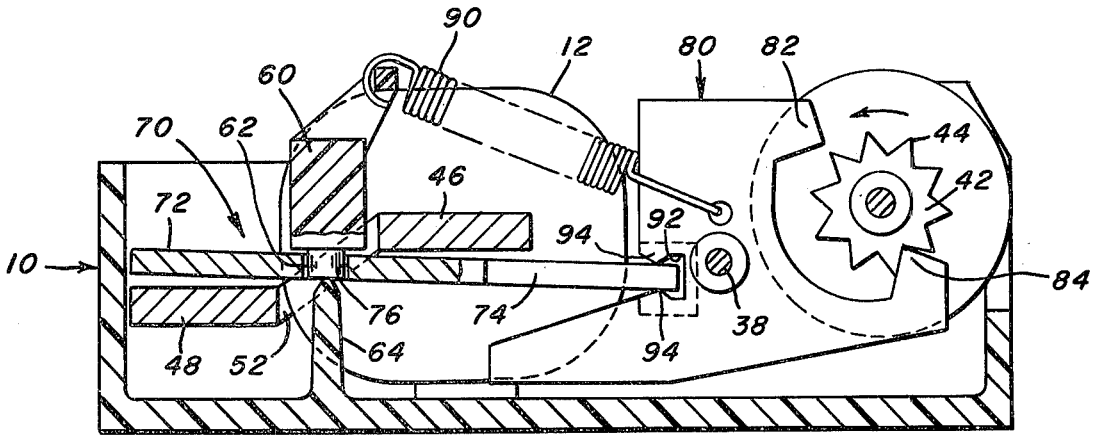
FIG. 2 is a plan view of the counting mechanism shown in FIG. 1.

Coil 12 has a central axially extending opening (not shown) into which is received leg 46 of a generally U-shaped core 50 comprised of legs 46 and 48, and slanted leg connecting portion 52. As best shown in FIG. 2, by virtue of slanted portion 52, legs 48 and 46 occupy vertically spaced but parallel planes. The core 50 on which is mounted coil 12 is secured to support structure 10 by means of screw 54.

Figure 3:
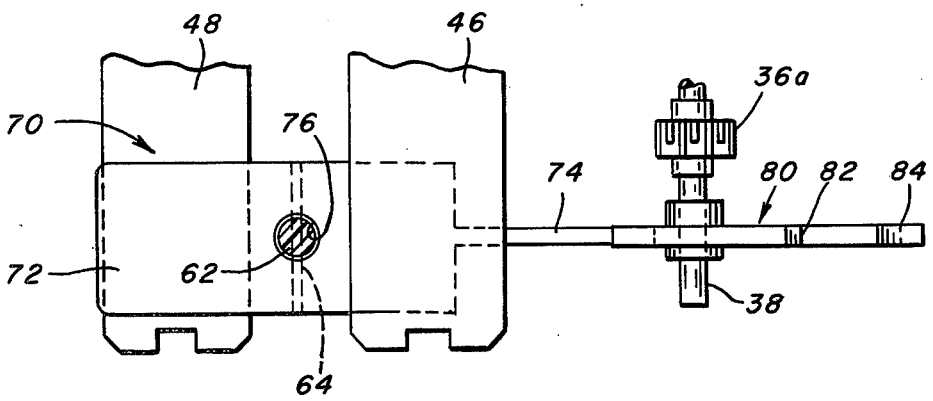
FIG. 3 shows the relationship of the clapper, verge and core in plan view apart from other elements of the mechanism.

As shown in FIG. 1 mounting boss 56 which is integrally formed on and upstanding from the bottom floor of support structure 10 and mounting boss 58 which is integrally formed and extends from the side wall of support structure 10, have aligned recesses which tightly receive tongues formed on either side of an insert 60 to securely mount insert 60 between bosses 56 and 58. As best shown in FIG. 2 a pin 62 extends from the bottom of insert 60 and is in alignment and in contact with the top of the central portion of pivot boss 64 which extends upwardly from bottom wall of support structure 10. Pin 62 is circular in cross section and is centrally located on and projects from the bottom of insert 60. As shown in FIG. 3 boss 64 has a lateral dimension which is coextensive with the width of wide portion 72 of clapper 70, clapper 70 being comprised of wide portion 72 and narrow tongue portion 74. A circular opening 76 into which is received pin 62 is formed in wide portion 72 at the center of gravity of the clapper. Since wide portion 72 of clapper 70 is pivotally supported by boss 64 and pin 62 is loosely received in opening 76 the clapper 70 is free to pivot about an axis coincident with the center of gravity of the clapper.

Verge 80 has pawls 82 and 84 formed thereon and is pivotally mounted on shaft 38 on which transfer pinions 36*a*-36*e* are also pivotally mounted. The center of gravity of the verge is coincident with the axis of shaft 38. As the verge 80 is pivoted back and forth about the axis of shaft 38, pawls 82 and 84 successively contact the sides of teeth 44 on star wheel 42 and project into recesses between adjacent teeth 44 to advance digit wheel 32*a*. For each complete revolution of digit wheel 32*a*, transfer pinion 36*a* causes digit wheel 32*b* to advance an angular distance corresponding to one digit. Similarly one revolution of each of the digit wheels 32*b*, 32*c*, 32*d* and 32*e*, causes the next order wheels 32*c*, 32*d*, 32*e*, and 32*f* respectively to advance on an angular distance corresponding to one digit by means of transfer pinions 36*b*, 36*c*, 36*d* and 36*e* respectively. A spring 90 extends between verge 80 and insert 60 and lightly biases the verge 80 in a counterclockwise direction whereby pawl 84 is urged into the recess between two adjoining teeth 44 on star wheel 42. A recess 92 is formed on verge 80 having opposed pivot points 94 between which the end of tongue portion 74 of clapper 70 is pivotally received. Referring to FIG. 2 it will be noted that in the embodiment shown therein the clapper 70 is a straight planar member and by reason of the fact that the legs 46 and 48 of core member 50 occupy vertically displaced planes, clapper 70 occupies a horizontal plane between the planes of legs 46 and 48 so that the portion of clapper 70 to the left of pivot boss 64 as viewed in FIG. 2 is above leg 48 and the portion of the clapper 70 to the right of boss 64 is beneath the leg 46.

The size, mass and the configuration of clapper 70 is such that its center of gravity is coincident with the point which it pivots on pin 62 and the top of boss 64. Similarly, the configuration, size and mass of verge 80 is such that the center of gravity of the verge is coincident with the point about which the verge pivots on shaft 38.

As pulses of electrical energy are received from the transmitting generator through leads 14 and 16, coil 12 is energized to magnetize core 50 whereby a magnetic force is created to attract the portion of clapper 70 underlying leg 46 to leg 46 and the portion of clapper 70 overlying leg 48 to leg 48. The magnetic circuit is completed through leg 46, portion 72 of clapper 70, leg 48 and slanted portion 52. This arrangement produces a couple of forces about the point about which the clapper 70 is rotated to produce a particularly strong pivoting force on the clapper for the amount of energy available from the generating source. For each pulse of energy received, the clapper 70 is rotated in a counterclockwise direction as viewed in FIG. 2 until the pawl 82 is seated in the recesses between teeth 44. This counterclockwise motion of the clapper, through the pivotal connection between the end of tongue portion 74 of the clapper and the pivot points 94 on verge 80 causes the verge 80 to rotate in a clockwise direction about the axis of shaft 38. This pivotal motion of the verge causes pawl 82 to project into a recess between two adjoining teeth 44 and to bear against the side surface of the lower tooth while at the same time pawl 84 is retracted from the recess it occupied between two adjacent teeth 44. This causes the wheel 32*a* to rotate an angular distance corresponding to approximately one half of the distance required to advance the wheel one digit. At the end of each pulse the coil 12 is deenergized and the magnetic attraction between the legs 46 and 48 and the portion 72 of clapper 70 is relieved allowing the verge to rotate in a counterclockwise direction under the influence of spring 90 to the position shown in FIG. 2. This will cause clapper 70 to be pivoted in a clockwise direction to the position shown in FIG. 2 and will cause the pawl 84 to project into the recess between the two teeth adjacent to it and retract the pawl 82 from the recess it was in, to advance the digit wheel 32*a* a distance corresponding to approximately one half of one digit whereby the combined clockwise movement of the verge 80 and the ensuring counterclockwise movement thereof causes the digit wheel 32*a* to be advanced in angular distance corresponding to one digit.

Figure 4:
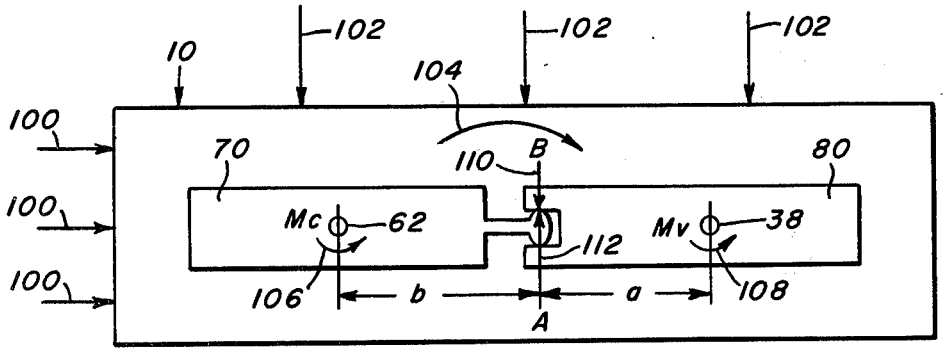
FIG. 4 is a schematic diagram showing the clapper and verge in elevation.

The operation of the invention will now be described with reference to FIG. 4 which shows in schematic form the relationship between the support structure 10 clapper 70 and verge 80. In the field the housing structure 10 may be subjected to straight line (linear) acceleration by reason of horizontal shocks administered to the support structure represented by the series of horizontal vectors 100. The support structure 10 may also be subjected to straight line vertical acceleration by vertical shocks represented by the series of vectors 102. Any straight line shock administered to the support structure at an angle to the direction of the vectors 100 or 102 can be broken down into horizontal and vertical components so that any such angular shock is in reality resolved into a combination of a horizontal and vertical shock administered in the direction shown by the vectors 100 and 102. As hereinabove explained the center of gravity of the clapper 70 is located at its pivot point and the center of the gravity of the verge is located at its pivot point which is the axis of shaft 38. Thus, the straight line thrust on the clapper 70 and on the verge is located at its pivot point which is the axis of shaft 38. Thus the straight line thrust on the clapper 70 and on the verge 80 will be transferred from the housing to the clapper and verge through their respective pivot points. Since the centers of gravity of the clapper and the verge are located at their respective pivot points neither of these elements will be subjected to any unbalanced moment tending to rotate them about their respective pivot points. Thus, the position of the clapper and the verge will remain fixed with respect to each other and to the support structure 70 when subjected to straight line acceleration in any direction. The digit counter wheel 32*a* therefore will not be advanced spuriously as a result of such shocks.

If, however, the support structure is subjected to angular acceleration as represented by the arcuate arrow 104 as a result of a shock, a further complexity is introduced. Since both the clapper 70 and verge 80 are free to rotate on their respective pivot points, the mass of each part will tend to keep it fixed in space. This means that when the support structure 10 is angularly accelerated in a clockwise direction the clapper 70 and the verge 80 will tend to rotate in a counterclockwise direction about their respective pivot points 62 and 38 with respect to the support structure 10 as denoted by the arrows 106 and 108. This relative counterclockwise motion of the clapper and the verge results in counter availing and opposite forces being imposed on each element by the other element as represented by the vectors 110 and 112 at the point of interconnection between the clapper and the verge.

When the support 10 is angularly accelerated in a clockwise direction, since the clapper and verge are free to rotate about their respective pivot axis the mass of the clapper produces a moment $M_c$ in the direction indicated by arrow 106 which resists angular acceleration of the clapper. At the same time the mass of the verge produces a moment $M_v$ in the direction indicated by arrow 108 resisting angular acceleration of the verge. As a result of moments $M_c$ and $M_v$, counter availing forces A and B are produced by the clapper and verge respectively at their point of interconnection. If these forces are equal the clapper and verge will maintain their relative positions with respect to each other and to the support under angular acceleration and the digit wheel 32*a* will not be caused to advance.

It is known that the moment (M) produced by the mass of any body free to rotate is the product of the moment of inertia (I) and its angular acceleration ($\alpha$) and may be expressed mathematically as $$M = I \times \alpha$$

In this case since the verge and clapper tend to remain fixed in space, the angular acceleration is the relative acceleration between the support and the clapper and the relative acceleration between the support and the verge, and both accelerations are equal.

The magnitude of the force A is known to be the resultant of the moment of verge $M_v$ dividied by the distance a between the pivot point of the verge and the point of interconnection between the verge and clapper and the magnitude of the force B is the resultant of the moment of the clapper $M_c$ divided by the distance b between the pivot point of the clapper and the point of interconnection. These relationships may be expressed mathematically as follows $$A = M_v/a$$
$$B = M_c/b$$

Since the moment of the verge $M_v$ is the product of the moment of inertia of the verge about its center of gravity $I_v$ and the angular acceleration $\alpha$, expressed mathematically $$M_v = I_v \times \alpha$$

and the moment of the clapper is the product of the moment of inertia of the clapper abouts its center of gravity $I_c$ and the angular acceleration $\alpha$, expressed mathematically $$M_c = I_c \times \alpha$$

the magnitude of forces A and B may be expressed as $$A = M_v/a = I_v \times \alpha/a$$
$$B = M_c/b = I_c \times \alpha/b$$

If A and B are equal then $$I_v \times \alpha/a = I_c \times \alpha/b$$

and $$I_v a = I_c/b$$

or $$I_v/I_c = a/b$$

Thus, by the designing of the clapper and verge so that the ratio of the moment of inertia of the verge to the moment of inertia of the clapper is equal to the ratio of the distance a to the distance *b* the magnitude of the forces A and B will be equal. Since these forces are opposite in direction they will cancel each other out and the verge and clapper will remain motionless with respect to each other and with respect to the support 10 when the support 10 is angularly accelerated due to shock. It will be appreciated that since the moment of the verge ($M_v$) and clapper ($M_c$) is dependent on size and material and since the location of the center of gravity of each is dependent on size and configuration, the values of these various parameters and the distances *a* and *b* may be selected to achieve the relationship between the moments of inertia $I_c$ and $I_v$ and distances *a* and *b* which will result in forces A and B being equal and opposite.

As mentioned above, to minimize the power necessary to operate the counter, the bias of spring 90 is very light, only that which is necessary to bias the clapper and verge to their initial positions as shown in FIG. 2 and rotate digit wheel 32*a* approximately one half of one digit. The spring bias therefor has no significant effect on either the clapper or verge when these elements are subjected to acceleration due to shock. Since the relationship defined above produces shock insensitivity which is not dependent on any significant spring or weight bias on the clapper and verge these elements may be made of lightweight material and of minimum size thereby further minimizing level of the power of the pulse from the generator necessary to operate the counter and still be insensitive to shock which induces linear as well as angular acceleration in the support structure.

I claim:

1. An electrically operated counting mechanism comprising a counter, a clapper mounted for pivotal movement about a first axis, means to induce pivotal movement of said clapper about said first axis in response to an electric signal, a verge mounted for pivotal movement about a second axis parallel to and spaced from said first axis, means drive connecting said verge to said counter to operate said counter in response to pivotal movement of said verge about said second axis, means interconnecting said clapper and said verge at a point intermediate said first and second axes whereby pivotal movement of said clapper in one direction will cause pivotal movement of said verge in the opposite direction, the centers of gravity of said clapper and said verge being in substantially the same plane as the plane containing said first and second axes.

2. The counting mechanism of claim 1, in which the ratio of the moment of inertia of said clapper about its center of gravity to the moment of inertia of said verge about its center of gravity is equal to the ratio of the distance between said first axis and said point and said second axis and said point.

3. An electrically operated counting mechanism comprising a counter , a clapper mounted for pivotal movement about a first axis, means to induce pivotal movement of said clapper about said first axis in response to an electric signal, a verge mounted for pivotal movement about a second axis parallel to and spaced from said first axis, means drive connecting said verge to said counter to operate said counter in response to pivotal movement of said verge about said second axis, means interconnecting said clapper and said verge at a point intermediate said first and second axes whereby pivotal movement of said clapper in one direction will cause pivotal movement of said verge in the opposite direction, the center of gravity of said clapper and said verge being respectively coicident with said first and second axes.

4. The counting mechanism of claim 3 in which said verge is spring biased to an initial position against movement caused by said clapper in response to said electric signal.

5. An electrically operated counting mechanism comprising a counter, a clapper mounted for pivotal movement about a first axis, means to induce pivotal movement of said clapper about said first axis in response to an electric signal, a verge mounted for pivotal movement about a second axis parallel to and spaced from said first axis, means drive connecting said verge to said counter to operate said counter in response to pivotal movement of said verge about said second axis, means interconnecting said clapper and said verge at a point intermediate said first and second axes whereby pivotal movement of said clapper in one direction will cause pivotal movement of said verge in the opposite direction, the ratio of the moment of inertia of said clapper about its center of gravity to the moment of inertia of said verge about its center of gravity being equal to the ratio of the distance between said first axis and said point and the distance between said second axis and said point.

* * * * *

UNITED STATES PATENT AND TRADEMARK OFFICE

CERTIFICATE OF CORRECTION

PATENT NO. : 4,031,361
DATED : June 21, 1977

INVENTOR(S) : Eberhard Moll and Leo M. Walch, Jr.

It is certified that error appears in the above-identified patent and that said Letters Patent are hereby corrected as shown below:

Column 2, Line 15, after "counter" insert --therein--.

Column 4, Line 30, after "point" insert --about--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*